US007658278B2

(12) United States Patent
Apps et al.

(10) Patent No.: US 7,658,278 B2
(45) Date of Patent: Feb. 9, 2010

(54) CAN TRAY

(75) Inventors: William P. Apps, Alpharetta, GA (US); Sean T. Ogburn, Lawrenceville, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 526 days.

(21) Appl. No.: 10/515,906

(22) PCT Filed: May 22, 2003

(86) PCT No.: PCT/US03/16472

§ 371 (c)(1),
(2), (4) Date: Jul. 25, 2005

(87) PCT Pub. No.: WO03/099665

PCT Pub. Date: Dec. 4, 2003

(65) Prior Publication Data

US 2005/0269239 A1 Dec. 8, 2005

(51) Int. Cl.
*B65D 1/36* (2006.01)

(52) U.S. Cl. ..... 206/203; 206/564; 220/509

(58) Field of Classification Search ..... 220/509, 220/511, 519, 507, 512, 513, 516, 517; 206/503, 206/427, 203, 445, 443, 557, 561, 564, 589, 206/490, 509

See application file for complete search history.

(56) References Cited

U.S. PATENT DOCUMENTS 5,031,774 A 7/1991 Morris et al.
D322,917 S 1/1992 Morris et al.
5,105,948 A 4/1992 Morris et al.
D330,621 S 10/1992 Apps
5,277,316 A 1/1994 Apps et al.
5,285,899 A 2/1994 Apps et al.
5,316,172 A 5/1994 Apps et al.
5,421,477 A 6/1995 Hammett
5,487,487 A 1/1996 Hammett
5,651,461 A * 7/1997 Apps et al. ..... 206/503
5,842,572 A * 12/1998 Apps et al. ..... 206/503

(Continued)

FOREIGN PATENT DOCUMENTS

EP 0915021 5/1999

OTHER PUBLICATIONS

International Search Report for Serial No. PCT/US03/16472, Sep. 17, 2003.

*Primary Examiner*—Jacob K Ackun, Jr.
(74) *Attorney, Agent, or Firm*—Carlson, Gaskey & Olds

(57) ABSTRACT

A can tray (10) includes a floor (12) and a plurality of support members (24) extending upwardly from a periphery of the floor. A plurality of upstanding projections (18,20) extend upwardly from the floor and define can-receiving (14) areas therebetween. Each of the projections includes concave surfaces (19,21) facing the can-receiving areas. The support members are hollow, such that support members of one can tray can be nested within the support members of an identical can tray stacked thereon. The plurality of projections includes a plurality of center projections (18) along at least one of two centerlines of the tray and a plurality of non-center projections (20) not on either of the two centerlines of the tray. The center projections extend higher than the non-center projections.

42 Claims, 13 Drawing Sheets

U.S. PATENT DOCUMENTS

| | | | | |
|---|---|---|---|---|
| D404,204 | S | 1/1999 | Apps | |
| 5,967,306 | A | 10/1999 | Umiker | |
| 6,021,913 | A | 2/2000 | McGrath | |
| 6,079,554 | A | 6/2000 | Hammett et al. | |
| 6,186,328 | B1 | 2/2001 | Apps | |
| 7,093,715 | B1 | 8/2006 | Apps | |
| 7,281,641 | B2 * | 10/2007 | Apps | 220/516 |
| 2002/0195452 | A1 * | 12/2002 | Apps | 220/515 |

* cited by examiner

CAN TRAY

This is a national stage application under 35 U.S.C. 371 of PCT/US03/16472.

BACKGROUND OF THE INVENTION

This invention relates to a tray for holding cans, and particularly beverage and soft drink cans.

Trays used to hold cans, such as soft drink or beer cans, typically include an open floor and side walls having a continuous band around the top in order to retain the cans within the tray during storage and transport. An example of such can tray is disclosed in U.S. Pat. No. 5,316,172. However, can trays of this type often do not provide adequate visibility into the tray in order to view its contents, or to read the label of the can held therein. Present can trays are also typically single walled structures, which while durable, may not be capable of providing enhanced torsion and bending strength which may be desired under certain circumstances. These trays also may not provide sufficient nesting with like trays during storage and transport.

Accordingly, a can tray is desired which provides visibility into the crate and the capability of reading the label of the cans stored therein, as well as providing enhanced strength and enhanced nestability when not in use.

SUMMARY OF THE INVENTION

A tray for supporting cans is provided, which has a floor member and a wall structure. The wall structure includes a plurality of support members around the periphery to the tray and windows between adjacent support members for providing visibility into the tray. The floor area includes upstanding projections extending upwardly therefrom. The support members and projections define a plurality of can receiving areas in which the cans are supported. The tray is capable of nesting with a similar tray. In one embodiment, the tray includes a handle bar member extending between two support members on the end wall, defining an opening thereunder by which a user may grasp the handle bar and manipulate the tray. In another embodiment, upstanding rib members are provided on the floor in order to impede the flow of liquid from the tray. In yet another embodiment, a cutout is provided on the outer surface of the support members for handling the tray. And in still another embodiment, the support members extend fully around the periphery of the tray.

BRIEF DESCRIPTION OF THE DRAWINGS

Other advantages of the present invention can be understood by reference to the following detailed description when considered in connection with the accompanying drawings wherein:

FIG. 12 is a perspective view of a fourth embodiment of a tray according to the present invention.

DETAILED DESCRIPTION OF THE PREFERRED EMBODIMENTS

Figure 1:
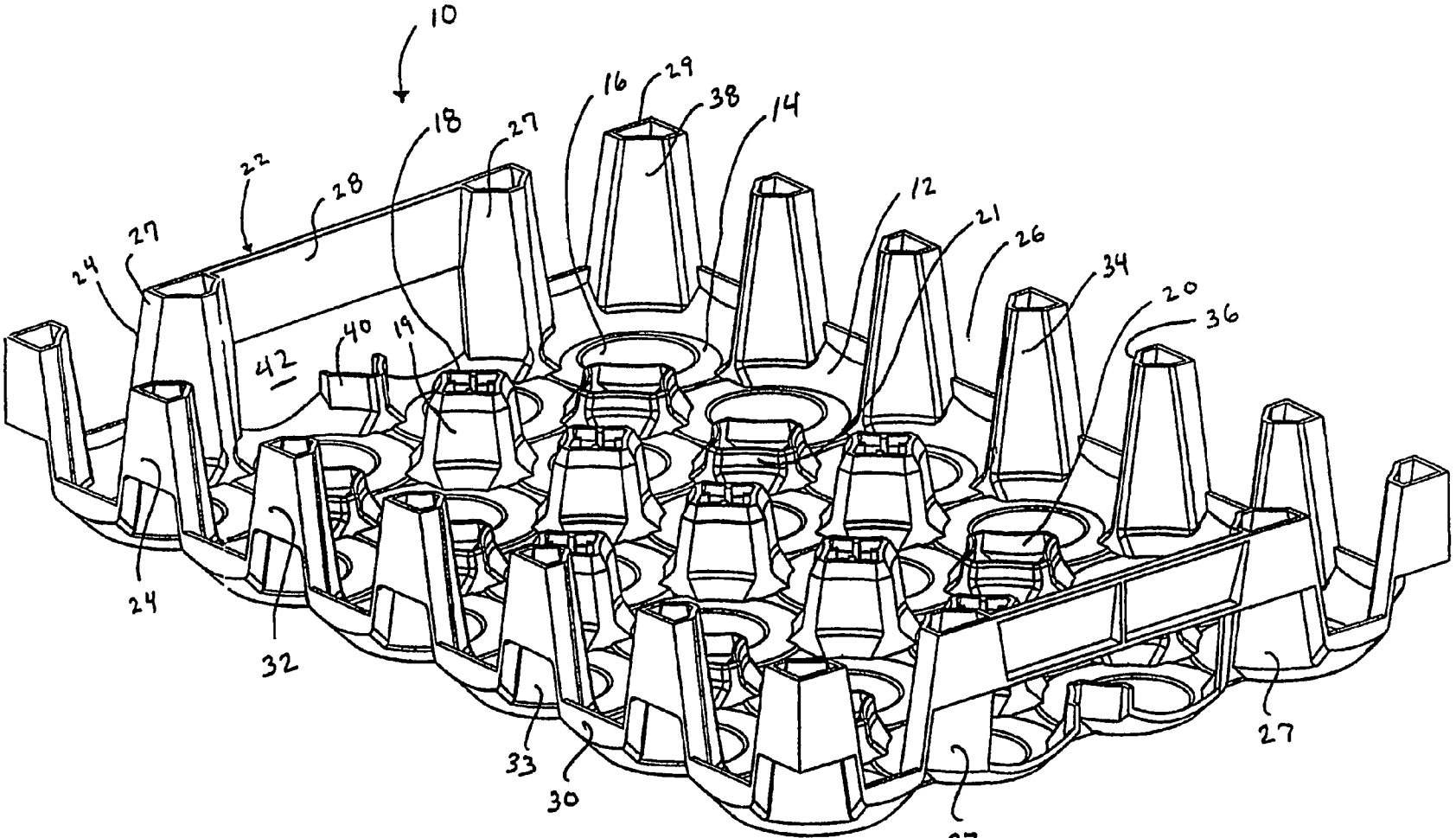
FIG. 1 is a perspective view of a first embodiment of a can tray according to the present invention.
Figure 2:
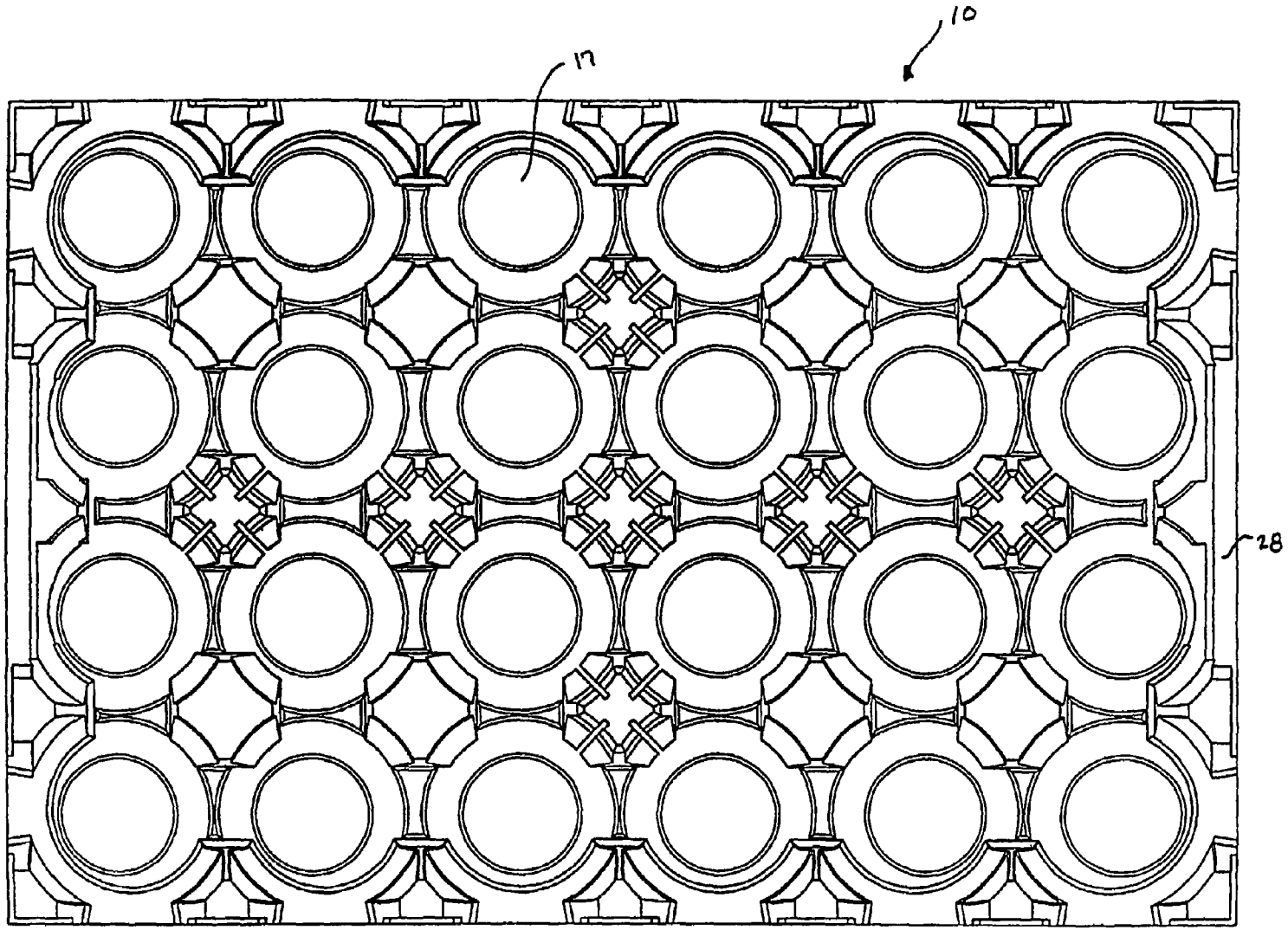
FIG. 2 is a bottom plan view of the tray of FIG. 1.
Figure 3:
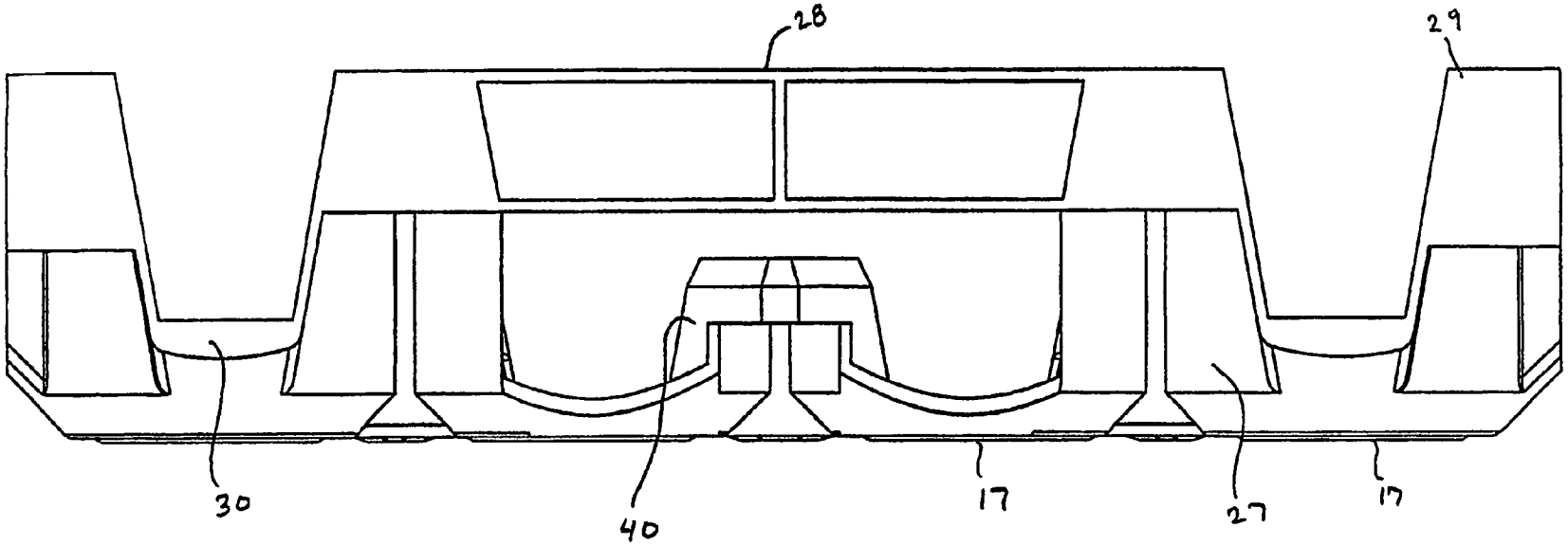
FIG. 3 is an end elevational view of the tray of FIG. 1.
Figure 4:
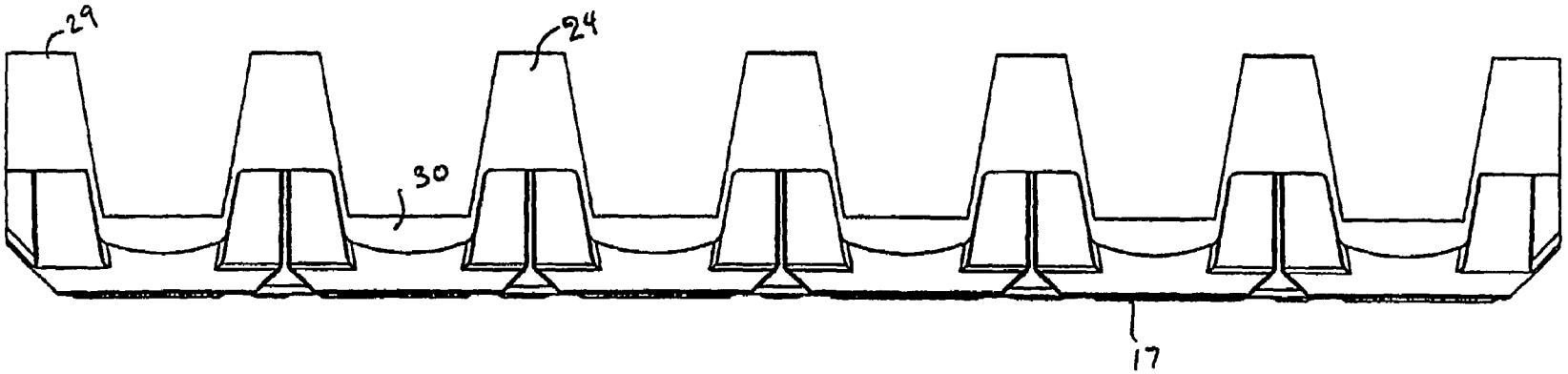
FIG. 4 is a side elevational view of the tray of FIG. 1.
Figure 5:
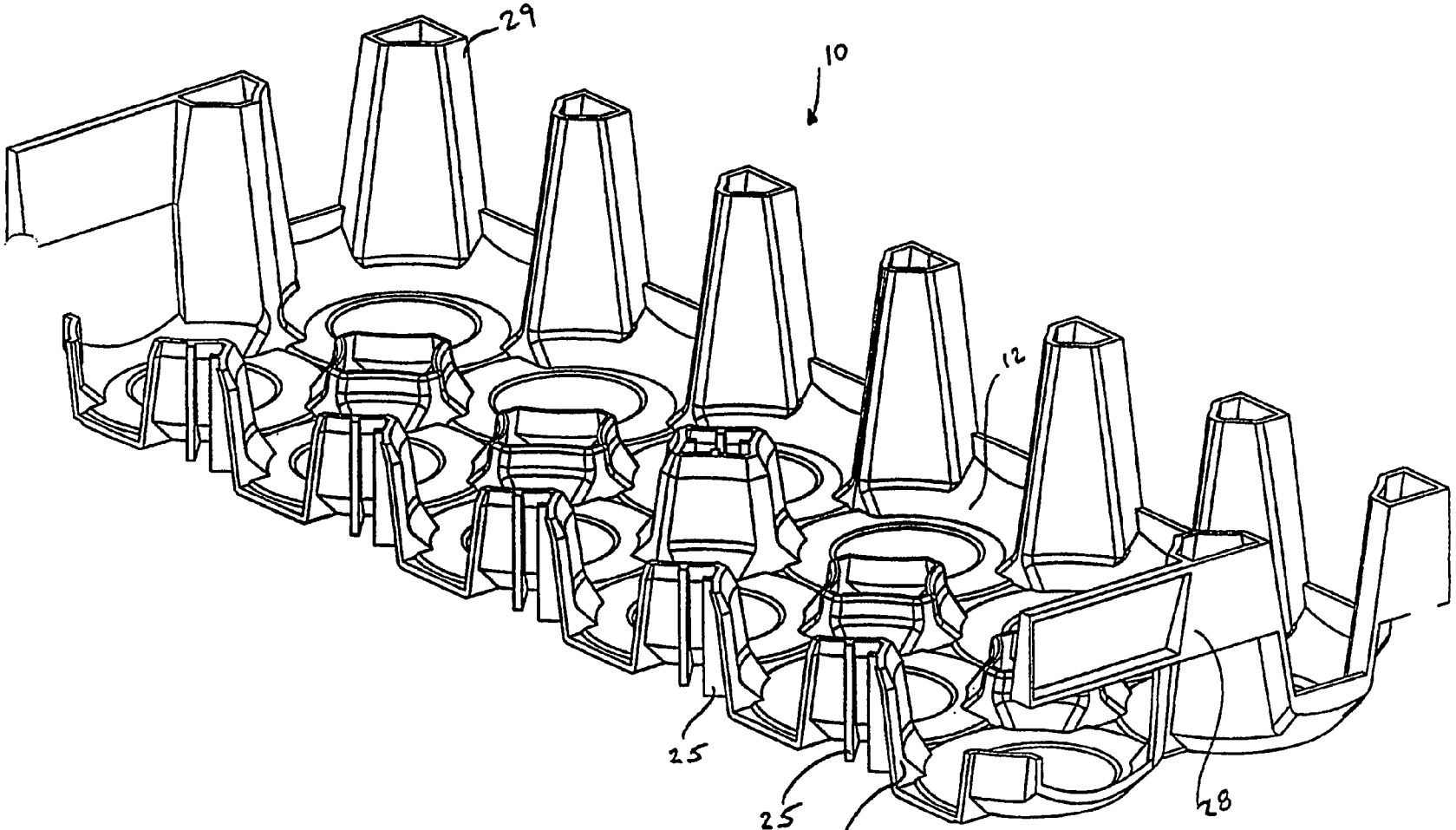
FIG. 5 is a perspective cross-sectional view of the tray of FIG. 1, taken along the longitudinal centerline.
Figure 6:
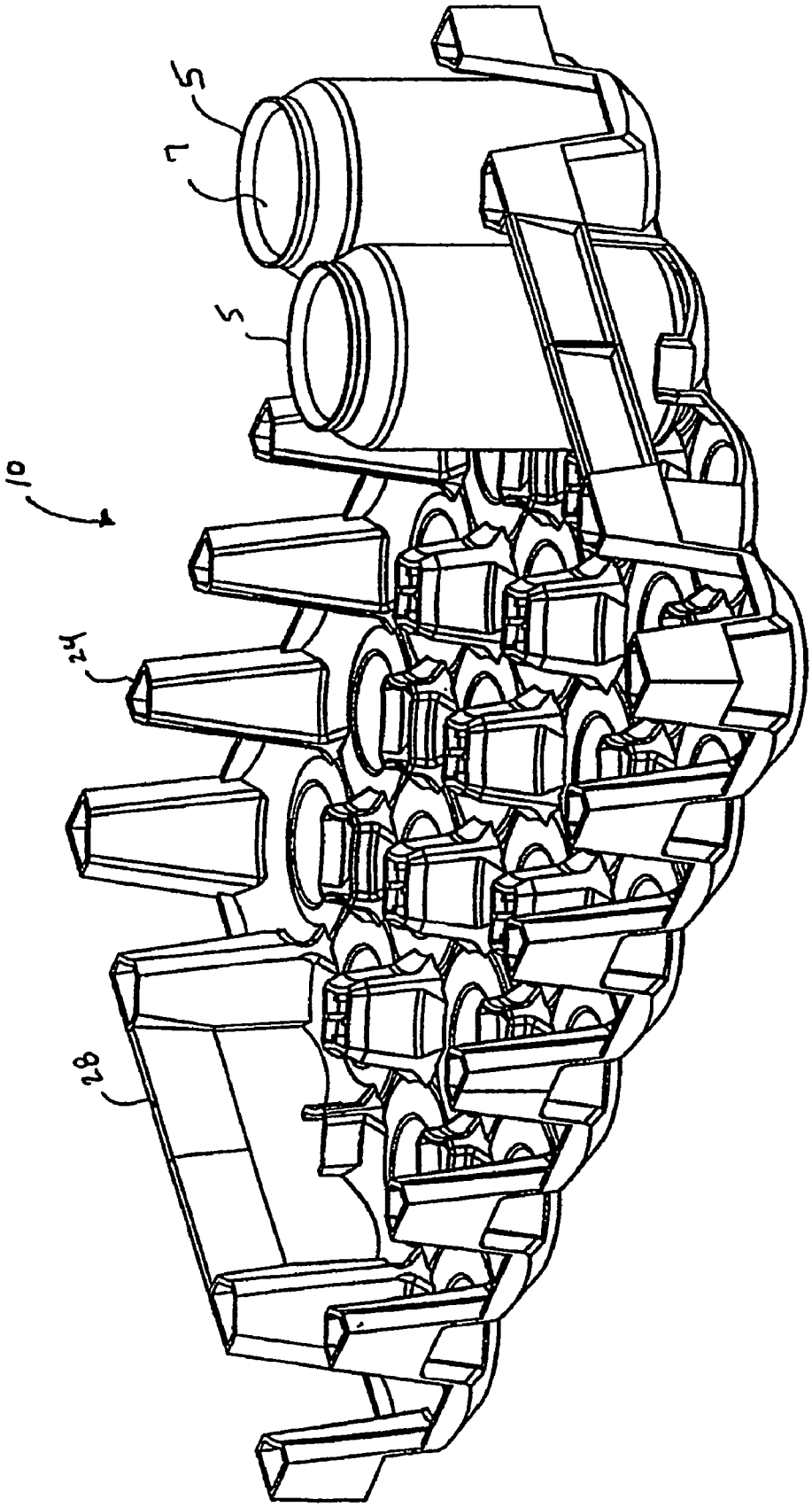
FIG. 6 shows the tray of FIG. 1 with cans stored therein.
Figure 7:
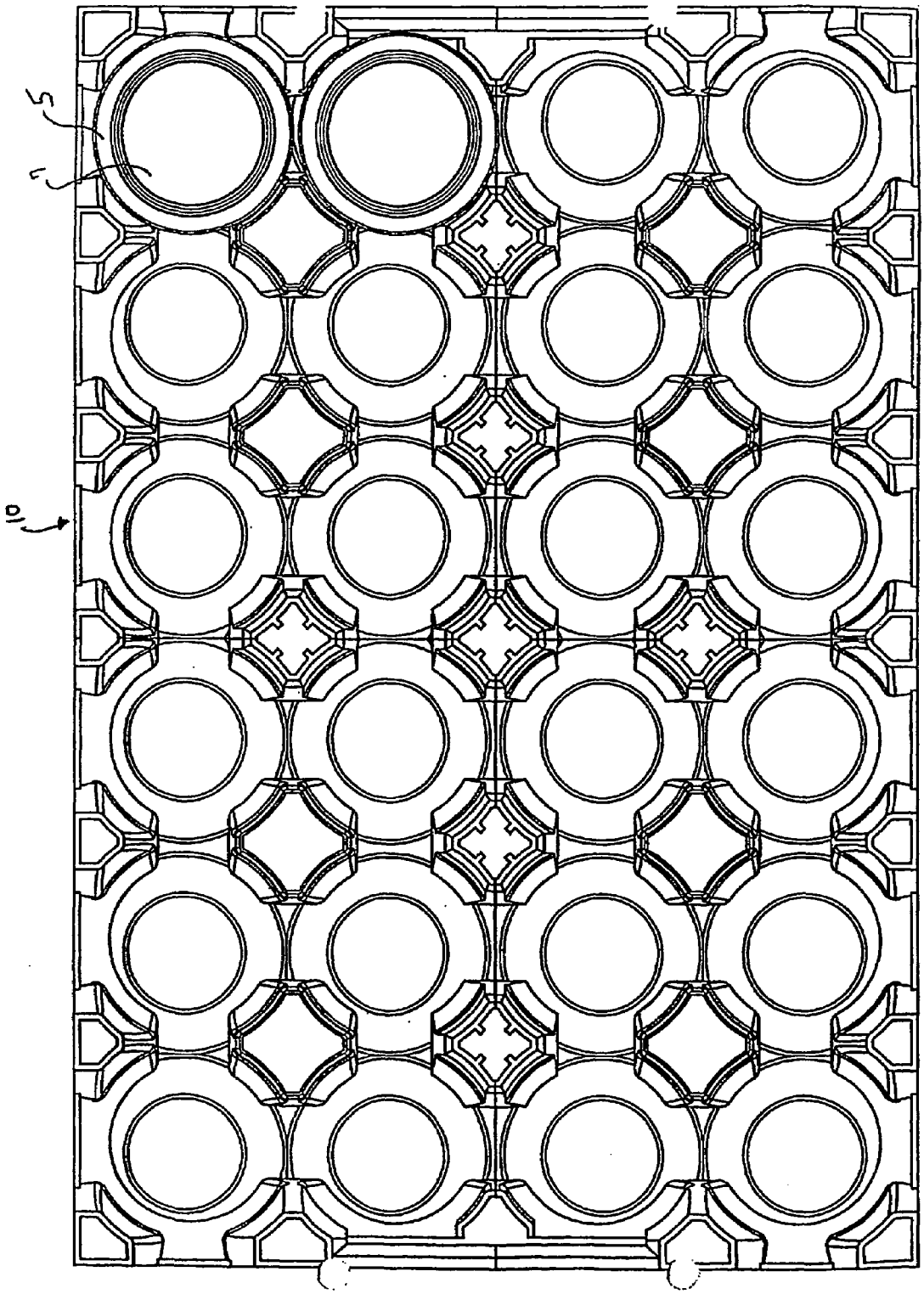
FIG. 7 is a top plan view of the tray of FIG. 6.

FIGS. 1-7 illustrate a first embodiment of a can tray according to the present invention. FIG. 1 shows a perspective view of the first embodiment of a can tray 10. Can tray 10 includes a floor member 12 having a plurality of can retaining pockets 14 in which cans 5 (see FIGS. 6-7) sit while tray 10 is in use. Retaining pockets 14 include a recessed area 16 which may be sized to receive the bottom of a can in a secure manner. Recessed area 16 also defines a corresponding protruding can capture area 17 on the bottom of tray 10 (FIG. 34). When in a stacked position, convex protruding area 17 is received by the typical recessed top area 7 of a can 5 subjacent thereto (FIG. 6). Cans 5 are typically those known in the art which are used for soft drinks, beer, and the like and are often formed of aluminum or steel. In the embodiments shown, tray 10 includes twenty-four can retaining pockets in a four by six array. Floor 12 also includes a plurality of projections extending up from the floor, which include relatively taller projections 18 extending along the center lines of tray 10, and relatively shorter projections 20 spaced away from the center lines (see FIG. 5). Projections 18, 20 are generally tapered and have surfaces 19, 21 respectively, that help to define individual can retaining pockets 14, as well as assist in supporting the cans in an upright, stable manner.

As shown in FIGS. 1-7, tray 10 also includes a wall structure 22 having around its periphery a plurality of upstanding side support members 24, which are spaced apart from each other to define alternating windows 26 therebetween. Windows 26 provide visibility into the tray 10 and also allows one to view the can from outside of the tray 10. Upstanding side members 24 are preferably hollow for nesting purposes and may also include strength ribs 25 disposed therein, as shown in FIG. 5. Side members 24 are also illustrated as being tapered from top to bottom. Members 24 are hollow in order to enhance the nestability of tray 10 when not in use such that the side members 24 of an upper tray 10 nestingly receive the side members of a like, lower tray. Side members also include end side members 27, and corner members 29.

As illustrated in this embodiment, tray 10 also includes a handle bar 28 that extends between adjacent support members 27 on the short side of the tray. Thus, handle bar 28, support members 27, and floor member 12 define an opening 42 below handle bar 28 that allows a user to grasp the tray 10 and manipulate the tray. Wall structure 22 also includes between adjacent side members 24 a relatively short connection member 30 extending between side members 24 and disposed beneath window 26. Connection member 30 serves to provide additional strength to tray 10 while not blocking the visibility into the crate or the can label in accordance of the goals of the present invention.

Support members 24 have a generally flat, planar outer surface 32, and an inner surface having two opposed can contact surfaces 34, 36 which extend into the interior of tray 10 and form can retaining pockets 14 along with projections 18 and/or 20. An opening 33 is disposed below outer surface 32 for ease of nesting. However, note that corner support members 29 of course, have only a single can retaining surface 38. Also, floor member 12 includes a relatively short peripheral projection 40 along the longitudinal centerline adjacent the handle bar 28 for providing lower support for cans disposed adjacent thereto.

Figure 8:
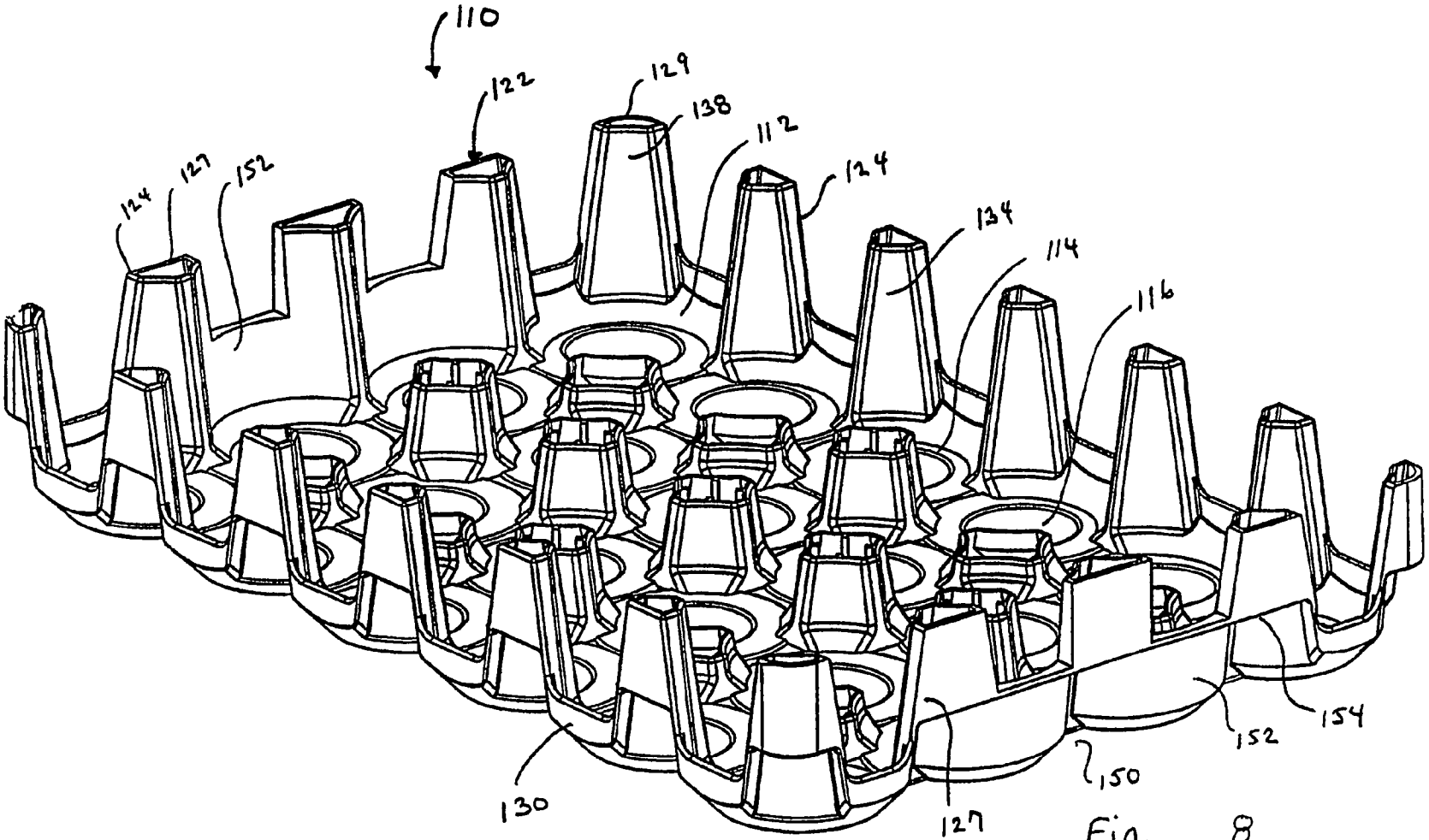
FIG. 8 is a second embodiment of a can tray according to the present invention.
Figure 9:
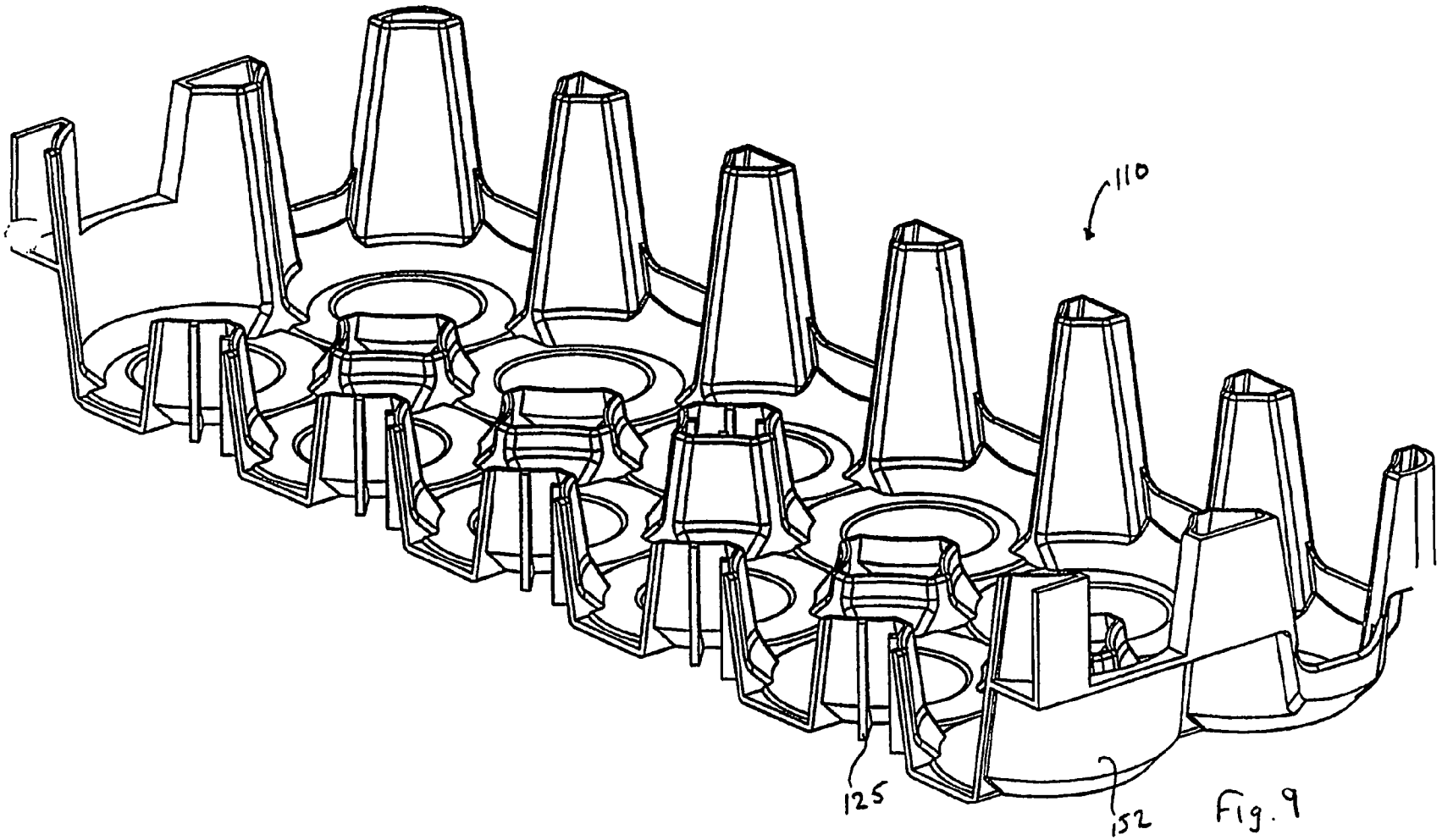
FIG. 9 is a perspective cross-sectional view of the tray of FIG. 8, taken-along the longitudinal centerline.

A second embodiment of the can tray according to the present invention is shown in FIGS. 8 and 9 as can tray 110. For ease of reference, similar features between the first embodiment and the second embodiment will be given a similar reference number, with the addition of a "1" prefix. Accordingly, tray 110 includes a floor member 112 and an upstanding wall structure 122 similar to that of the first embodiment. However, the second embodiment differs from the first in the area of the handle along the short side of the tray 10. Specifically, support members 127 have a cutout 150 formed along their external surface while joined by a contoured inner surface 152. The cutout thus provides a surface 154 by which a tray 110 may be lifted and handled. Inner surface 152 provides for additional can support as well as provides protection for the cans such that a user's fingers are not permitted to interfere with the cans.

Figure 10:
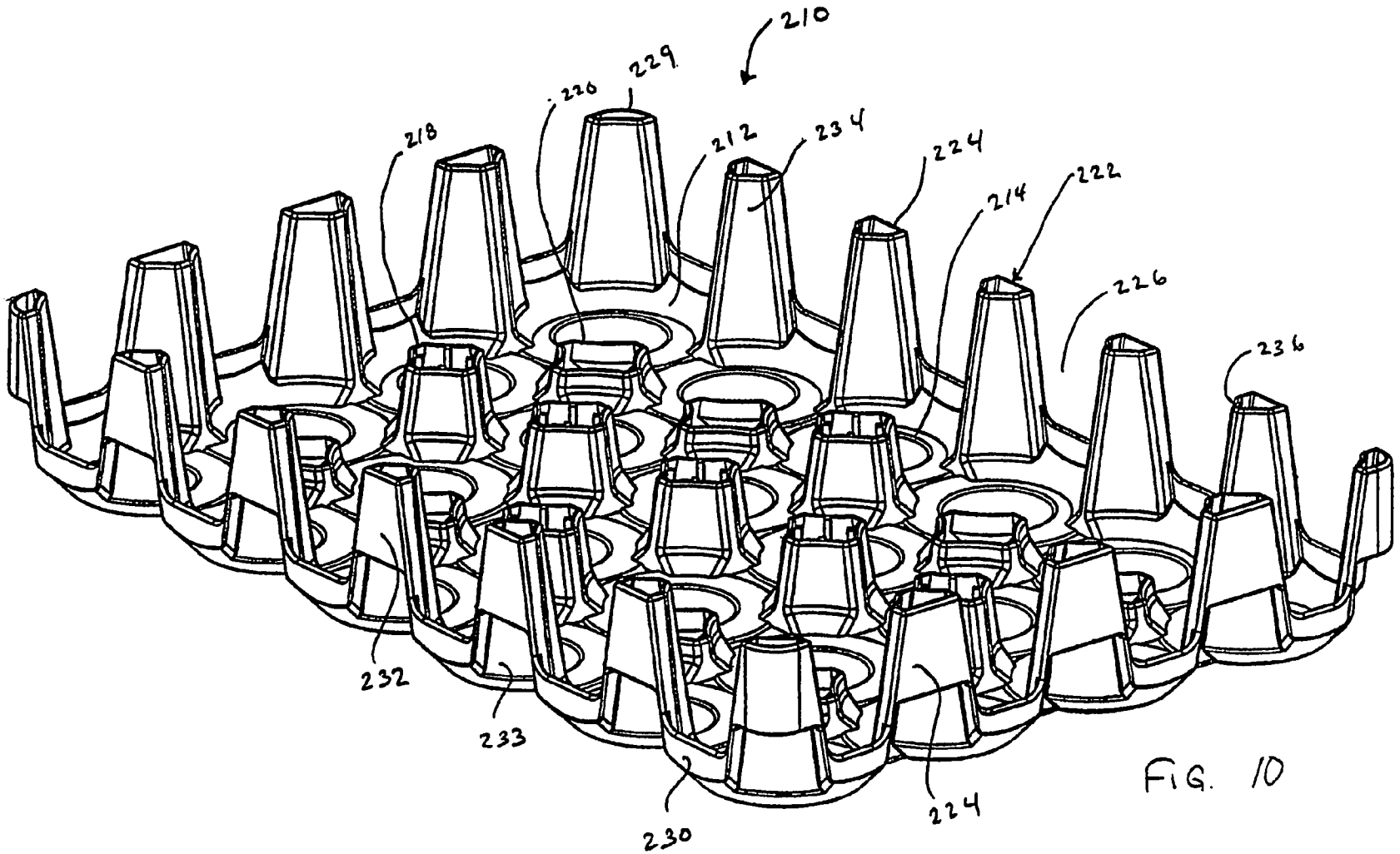
FIG. 10 illustrates a third embodiment of a can tray according to the present invention.
Figure 11:
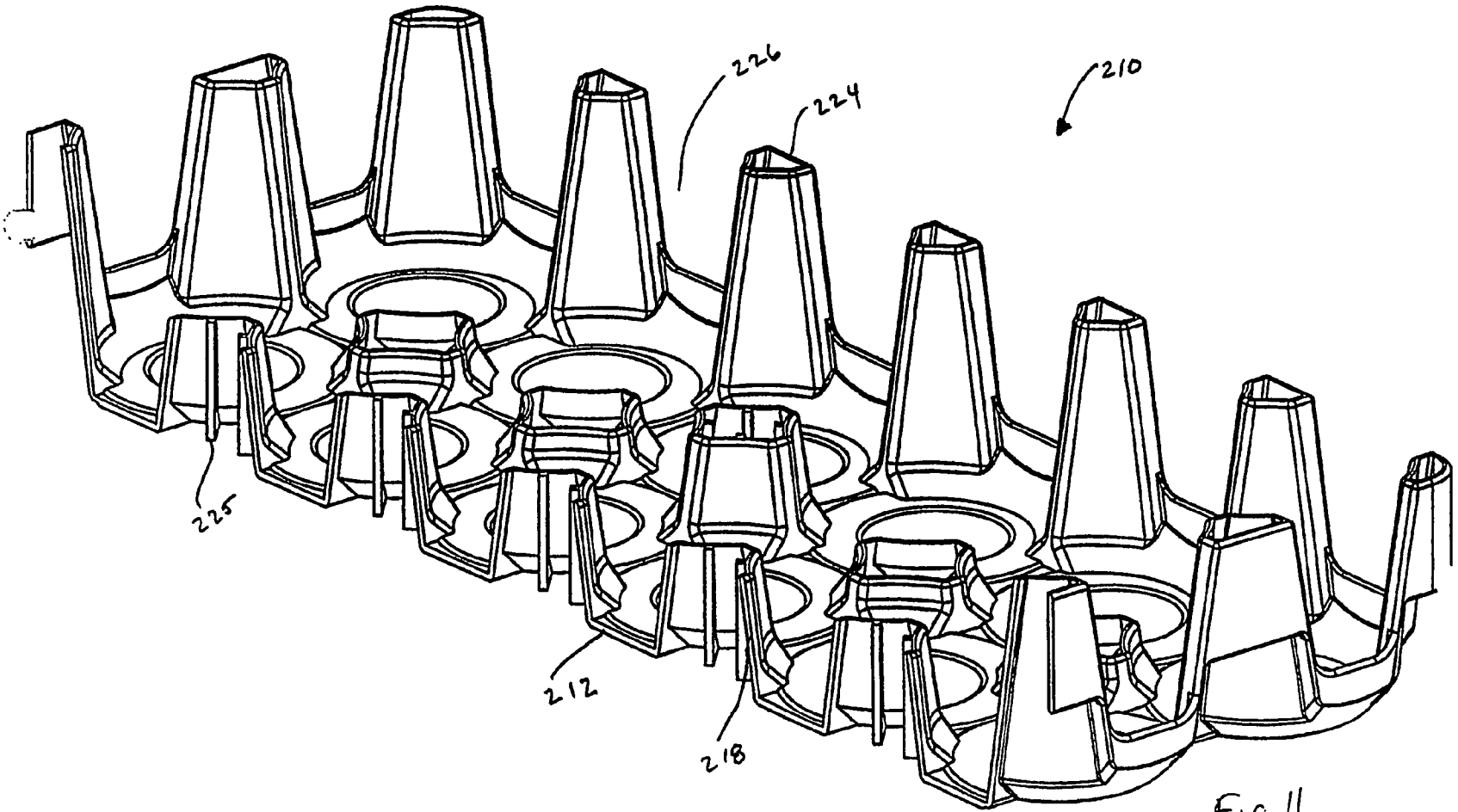
FIG. 11 is a perspective cross-sectional view of the tray of FIG. 10, taken along the longitudinal centerline.
Figure 17:
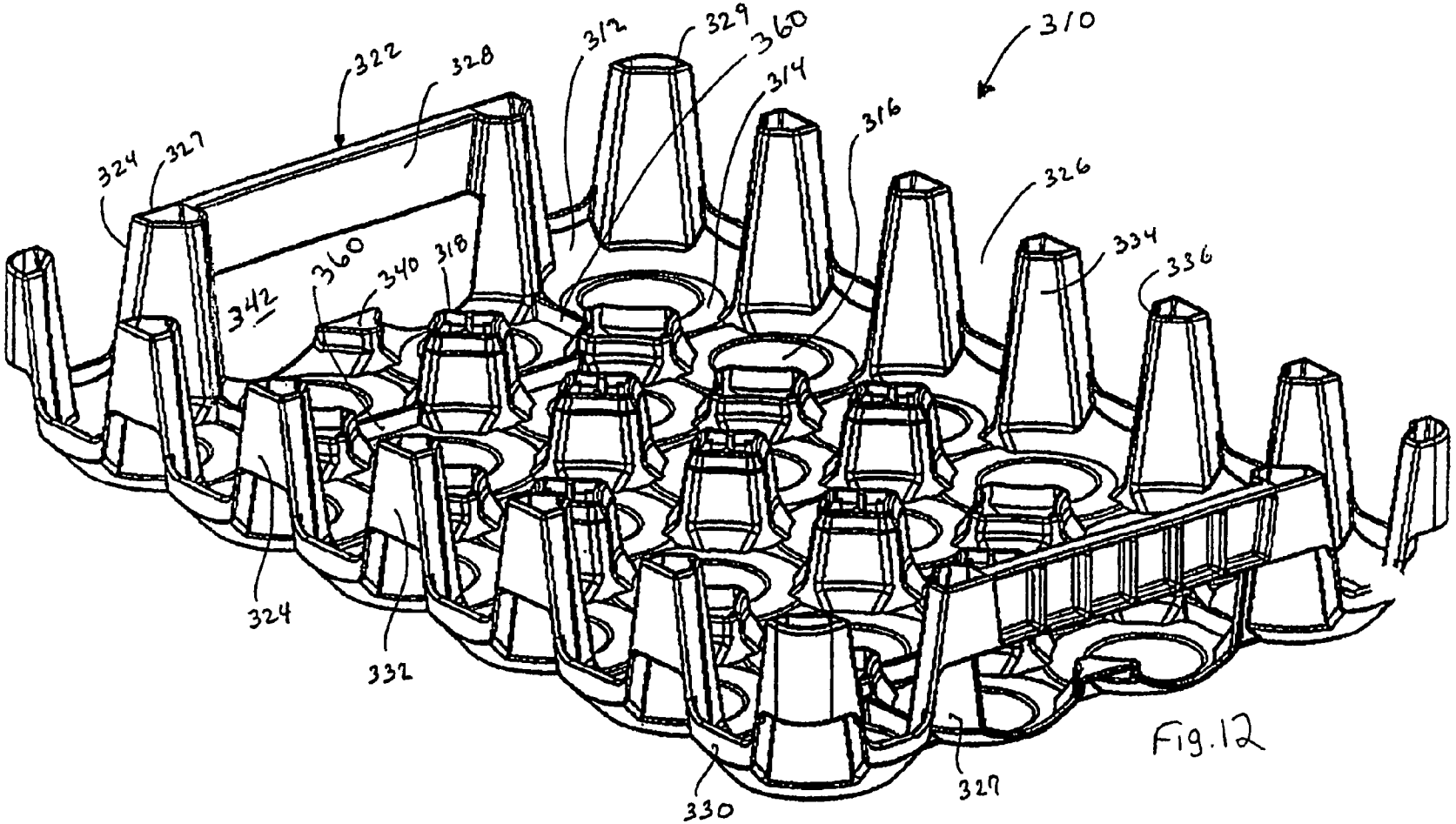

FIGS. 10 and 11 illustrate a third embodiment of a can tray 210 according to the present invention. Those features of can tray 210 which are similar to those of the first embodiment will bear a similar reference number with the addition of a "2" prefix. Thus, tray 210 includes a floor member 212 and an upstanding wall structure 222. Unlike the previous embodiments, tray 212 does not include a formal handle area but instead has a plurality of support members 224 extending around the periphery of tray 210. This allows complete visibility and can label access around the periphery of tray 210 through windows 226.

Figure 13:
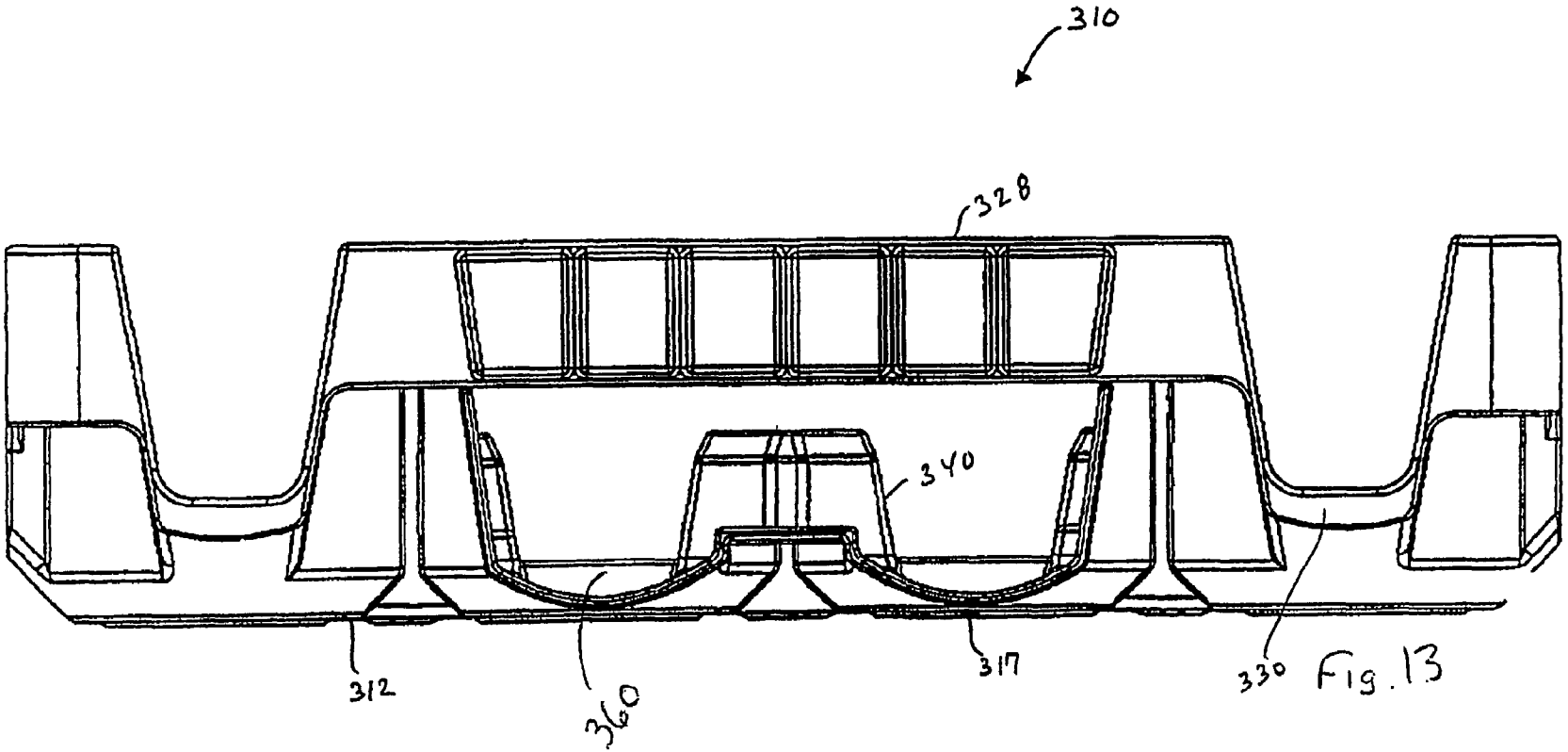
FIG. 13 is an end elevational view of the tray of FIG. 12.

FIGS. 12 and 13 illustrate a fourth embodiment of a can tray 310 according to the present invention. Those features of can tray 310 which are similar to those of the first embodiment will bear a similar reference number with the addition of a "3" prefix. Thus, tray 310 includes a floor member 312 and an upstanding wall structure 322. Tray 310 is similar to tray 10, with the addition of a plurality of rib members 360 proximate each short wall of tray 310. Rib members 360 provide additional strength to the tray 310, but also provide a leakage barrier. Should a can 5 contained within tray 310 happen to leak, the liquid that travels to the long walls will be prevented from spilling from the tray by connection members 330. However, the short walls do not have connection members under the handle area. Accordingly, liquid traveling to that area would spill from the tray without rib members 360 to block its travel. The long wall view and bottom plan view of the first embodiment should be generally applicable to this fourth embodiment. The rib members 360 could also be provided in any of the preceding embodiments in FIGS. 1-11.

Each of the tray embodiments shown herein is generally symmetrical about its centerlines. Preferably the trays disclosed herein are integrally formed of injection molded plastic to form a unitary construction. It is understood that the term "can label" is used herein to generically define a printed can, whether there is a separate label attached thereto, or not. While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

The invention claimed is:

1. A can tray comprising:

a floor;

a plurality of support members extending upwardly from a periphery of the floor;

a plurality of upstanding projections extending upwardly from the floor, the projections defining a plurality of can-receiving areas therebetween, wherein the plurality of support members are taller than the plurality of upstanding projections; and a wall located between each of the plurality of support members, wherein each of the walls is spaced apart from an adjacent wall.

2. The can tray of claim 1 wherein the plurality of upstanding projections includes a plurality of center projections along a centerline of the can tray and a plurality of non-center projections not along the centerline of the can tray, wherein the center projections are taller than the non-center projections.

3. The can tray of claim 1 wherein the plurality of upstanding projections includes a plurality of center projections each along at least one of two centerlines of the can tray and a plurality of non-center projections not along either of the two centerlines of the can tray, wherein the center projections are taller than the non-center projections.

4. The can tray according to claim 1, wherein each of the projections includes a plurality of exterior concave surfaces each adjacent one of the can-receiving areas.

5. The can tray of claim 4 wherein each of the projections includes at least one vertically-extending rib adjacent each of the exterior concave surfaces.

6. The can tray according to claim 1, wherein the can tray can be nested at least partially within an identical can tray stacked thereon.

7. The can tray of claim 6 wherein the support members of the can tray are insertable into support members of the identical can tray stacked thereon.

8. The can tray according to claim 1, further including a plurality of windows, each defined between an adjacent pair of the plurality of support members.

9. The can tray of claim 8 wherein the windows are upwardly-open.

10. The can tray according to claim 1 further including at least one handle extending between adjacent support members and defining an opening between the handle and the floor.

11. The can tray according to claim 1 wherein the plurality of support members and the plurality of projections are hollow and each of the plurality of support members includes an upper opening through the can tray.

12. The can tray of claim 11 wherein at least some of the plurality of projections include an upper opening through the can tray.

13. The can tray according to claim 1 further including a plurality of upstanding ribs extending upwardly from the floor for impeding the flow of liquid from the tray.

14. The can tray of claim 13 wherein the ribs connect adjacent pairs of projections and are substantially shorter than the projections.

15. The can tray according to claim 1 wherein the plurality of support members each include an inner wall and an outer wall, and wherein the plurality of support members includes a plurality of end members having a cutout portion in the outer wall.

16. The can tray of claim 15 wherein the inner wall of the plurality of end members have concave interior surfaces.

17. The can tray of claim 1 wherein the plurality of support members includes a plurality of end members each having at least one concave interior surface and an exterior surface.

18. The can tray according to claim 1, wherein the floor, the support members and the projections are all integrally molded as a single piece of plastic.

19. The can tray according to claim 1 further including a plurality of beverage cans each disposed in one of the can-receiving areas.

20. The can tray according to claim 1, wherein the floor has an upper surface defining can pockets as the can-receiving areas for receiving the bottoms of cans and a lower surface having a plurality of protruding can capture areas for protruding into a recessed top area of the cans.

21. The can tray as recited in claim 1 wherein the plurality of support members do not include a vertical recess on an outer surface.

22. The can tray as recited in claim 1 wherein the plurality of upstanding projections do not include a vertical recess on an outer surface.

23. The can tray as recited in claim 2 wherein each of the plurality of non-center projections are defined by a plurality of spaced apart walls that define a hollow portion therebetween.

24. The can tray as recited in claim 8 wherein each of the walls is located under one of plurality of the windows.

25. A can tray comprising:

a floor;

a plurality of support members extending upwardly from a periphery of the floor, each adjacent pair of support members defining an upwardly-open window therebetween; and a plurality of upstanding projections extending upwardly from the floor, the projections defining a plurality of can-receiving areas therebetween, wherein the plurality of upstanding projections includes a plurality of center projections along a centerline of the can tray and a plurality of non-center projections not along the centerline of the can tray, wherein the center projections are taller than the non-center projections, the plurality of support members are taller than the plurality of upstanding projections, and each of the plurality of non-center projections are defined by a plurality of spaced apart walls that define a hollow portion therebetween.

26. The can tray of claim 25 wherein each of the windows has a height defined from a bottom of each of the windows to a top of the adjacent pair of support members that is significantly more than half a height of the adjacent pair of support members.

27. The can tray according to claim 25 wherein each of the projections includes four concave exterior surfaces, each adjacent one of the can-receiving areas.

28. The can tray according to claim 25, wherein the plurality of support members each include an inner wall and an outer wall, and wherein the plurality of support members includes a plurality of end members having a cutout portion in the outer wall.

29. The can tray of claim 28 wherein the inner wall of the plurality of end members have concave interior surfaces.

30. The can tray according to claim 25, wherein the plurality of support members and the plurality of projections are hollow.

31. The can tray as recited in claim 25 wherein the plurality of support members do not include a vertical recess on an outer surface.

32. The can tray as recited in claim 25 wherein the plurality of upstanding projections do not include a vertical recess on an outer surface.

33. The can tray as recited in claim 25 including a wall located between each of the plurality of support members, and each of the walls is spaced apart from an adjacent wall.

34. The can tray as recited in claim 33 wherein each of the walls is located under one of the plurality of windows.

35. A can tray comprising:

a floor;

a plurality of support members extending upwardly from a periphery of the floor, each adjacent pair of support members defining an upwardly-open window therebetween, wherein each of the windows has a height defined from a bottom of the window to a top of the adjacent pair of support members that is significantly more that half a height of the adjacent pair of support members;

a plurality of hollow upstanding projections extending upwardly from the floor, the projections defining a plurality of can-receiving areas therebetween; and a wall located between each of the plurality of support members, wherein each of the walls is spaced apart from an adjacent wall.

36. The can tray of claim 35 wherein each of the support members includes an inner wall and an outer wall, such that the support members of the can tray would nest within the support members of an identical tray stacked thereon.

37. The can tray as recited in claim 35 wherein the plurality of support members do not include a vertical recess on an outer surface.

38. The can tray as recited in claim 35 wherein the plurality of upstanding projections do not include a vertical recess on an outer surface.

39. The can tray as recited in claim 35 wherein the plurality of upstanding projections includes a plurality of center projections along a centerline of the can tray and a plurality of non-center projections not along the centerline of the can tray, the center projections are taller than the non-center projections, and each of the plurality of non-center projections are defined by a plurality of spaced apart walls that define a hollow portion therebetween.

40. A can tray comprising:

a floor;

a plurality of support members extending upwardly from a periphery of the floor; and a plurality of upstanding projections extending upwardly from the floor, the projections defining a plurality of can-receiving areas therebetween, wherein the plurality of support members are taller than the plurality of upstanding projections, wherein the can tray does not include ribs connecting the plurality of upstanding projections to the plurality of support members.

41. The can tray of claim 40 wherein the can tray does not include ribs connecting the plurality of upstanding projections to one another.

42. The can tray of claim 26 wherein the can tray does not include ribs connecting the plurality of upstanding projections to the plurality of support members, and the can tray does not include ribs connecting the plurality of upstanding projections to one another.

* * * * *